US010880982B2

(12) United States Patent
Hsu et al.

(10) Patent No.: US 10,880,982 B2
(45) Date of Patent: Dec. 29, 2020

(54) LIGHT GENERATION SYSTEM USING METAL-NONMETAL COMPOUND AS PRECURSOR AND RELATED LIGHT GENERATION METHOD

(71) Applicant: TAIWAN SEMICONDUCTOR MANUFACTURING COMPANY LTD., Hsinchu (TW)

(72) Inventors: Ching-Hsiang Hsu, Hsinchu (TW); Feng Yuan Hsu, Yilan County (TW); Hsu-Kai Chang, Hsinchu (TW); Chi-Ming Yang, Hsinchu (TW)

(73) Assignee: TAIWAN SEMICONDUCTOR MANUFACTURING COMPANY LTD., Hsinchu (TW)

( * ) Notice: Subject to any disclaimer, the term of this patent is extended or adjusted under 35 U.S.C. 154(b) by 0 days.

(21) Appl. No.: 16/439,387

(22) Filed: Jun. 12, 2019

(65) Prior Publication Data

US 2020/0045801 A1 Feb. 6, 2020

Related U.S. Application Data

(60) Provisional application No. 62/712,477, filed on Jul. 31, 2018.

(51) Int. Cl.
*H05G 2/00* (2006.01)

(52) U.S. Cl.
CPC ..... *H05G 2/008* (2013.01); *H05G 2/005* (2013.01); *H05G 2/006* (2013.01)

(58) Field of Classification Search
CPC ..... H05G 2/00; H05G 2/001; H05G 2/003; H05G 2/005; H05G 2/006; H05G 2/008
USPC ..... 250/504 R
See application file for complete search history.

(56) References Cited

U.S. PATENT DOCUMENTS

| | | | | |
|---|---|---|---|---|
| 8,764,995 | B2 | 7/2014 | Chang et al. | |
| 8,796,666 | B1 | 8/2014 | Huang et al. | |
| 8,828,625 | B2 | 9/2014 | Lu et al. | |
| 8,841,047 | B2 | 9/2014 | Yu et al. | |
| 8,877,409 | B2 | 11/2014 | Hsu et al. | |
| 9,093,530 | B2 | 4/2015 | Huang et al. | |
| 9,184,054 | B1 | 11/2015 | Huang et al. | |
| 9,256,123 | B2 | 2/2016 | Shih et al. | |
| 9,529,268 | B2 | 12/2016 | Chang et al. | |
| 9,548,303 | B2 | 1/2017 | Lee et al. | |
| 2004/0200977 | A1* | 10/2004 | Rieger | H05G 2/00 250/398 |
| 2016/0073486 | A1* | 3/2016 | Teramoto | H01S 3/23 250/504 R |

* cited by examiner

*Primary Examiner* — Jason L McCormack
(74) *Attorney, Agent, or Firm* — WPAT, P.C., Intellectual Property Attorneys; Anthony King

(57) ABSTRACT

A light generation system is provided. The light generation system includes a vaporization device, a laser device and a lens structure. The vaporization device is configured to vaporize a metal-nonmetal compound to generate a metal-nonmetal precursor gas. The laser device is configured to provide laser light, and irradiate the metal-nonmetal precursor gas released from the vaporization device with the laser light to emit a light signal. The lens structure is configured to direct the light signal toward a photomask used in a lithography process.

20 Claims, 10 Drawing Sheets

| | Pure Ti | | | | MO-Ti | | | |
|---|---|---|---|---|---|---|---|---|
| | Solid To Liquid | Liquid To Gas | Ti-Ti | Total | Liquid To Gas | Gas | Ti-O Ti-C Ti-Cl | Total |
| Molar amount (Mole) | $0.2\times10^{12}$ | $0.2\times10^{12}$ | $0.2\times10^{12}$ | | $0.9\times10^{9}$ | $0.9\times10^{9}$ | | |
| Heat (Joule) | $2.83\times10^{15}$ | $85\times10^{15}$ | $2.82\times10^{16}$ | $10^{16}$ | $3.91\times10^{13}$ | $4.5\times10^{14}$ | $0.3\times10^{12}$ | $10^{14}$ |

FIG. 6

LIGHT GENERATION SYSTEM USING METAL-NONMETAL COMPOUND AS PRECURSOR AND RELATED LIGHT GENERATION METHOD

PRIORITY CLAIM AND CROSS-REFERENCE

The present application claims priority to U.S. Provisional Patent Application No. 62/712,477, filed on Jul. 31, 2018, which is incorporated by reference herein in its entirety.

BACKGROUND

The present disclosure relates to light generation, and more particularly, to a light generation system using metal-nonmetal compounds as precursors to be excited by laser light, and a related light generation method.

Technological advances in integrated circuit (IC) materials and design have produced generations of ICs where each generation has smaller and more complex circuits than the previous generation. In the course of IC evolution, the number of interconnected devices per chip area has generally increased, while the smallest component or line that can be created using a fabrication process has decreased. This scaling down process has increased the complexity of IC processing and manufacturing. For these advances to be realized, the need to perform higher resolution lithography processes grows. Since an extreme ultraviolet (EUV) light beam has an extremely short wavelength, EUV lithography is considered a next-generation technology which allows exposure of relatively fine circuit patterns.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

FIG. 6 shows energy required for vaporizing and exciting a metal-nonmetal compound in accordance with some embodiments.

DETAILED DESCRIPTION

Figure 1A:
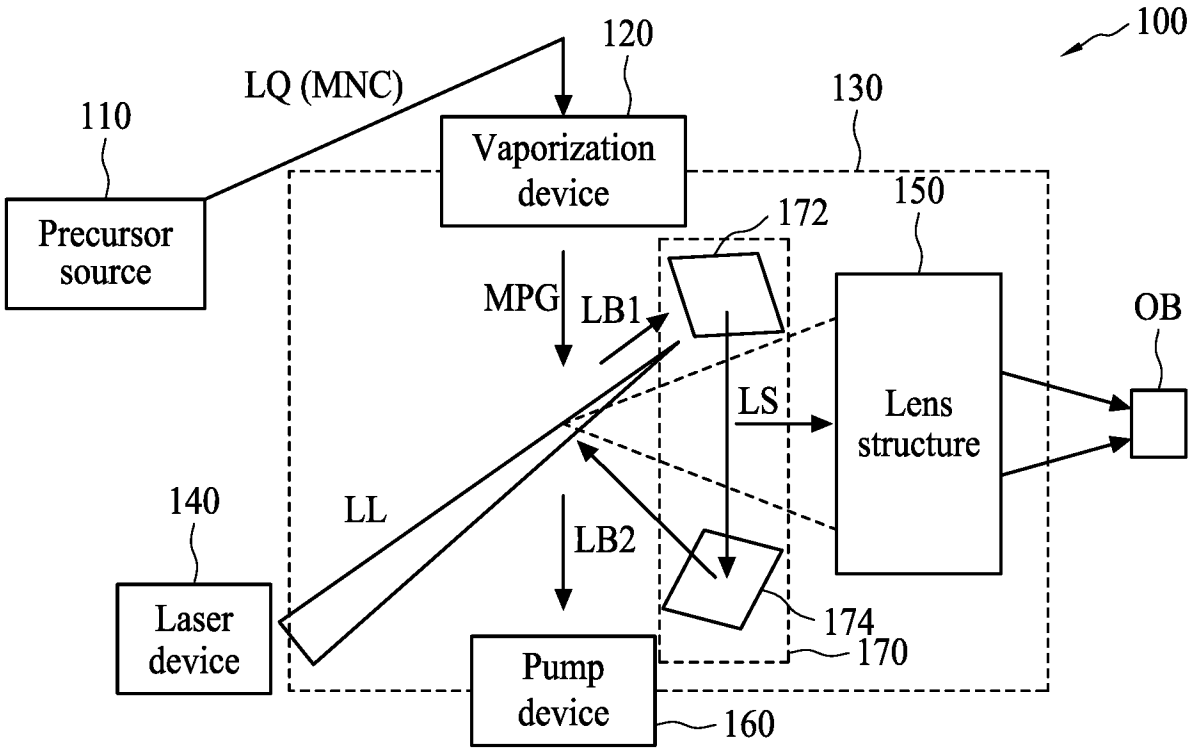
FIG. 1A illustrates an exemplary light generation system in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

The advanced lithography process, method, and materials described in the current disclosure can be used in many applications, including fin-type field effect transistors (FinFETs). For example, the fins may be patterned to produce a relatively close spacing between features, for which the above disclosure is well suited. In addition, spacers used in forming fins of FinFETs can be processed according to the above disclosure.

A laser-produced plasma (LPP) source is one of promising candidates for sources of EUV lithography. However, the conversion efficiency of laser into EUV light is low because a high power pulsed laser is required to excite plasmas. For example, when a high power pulsed laser is focused on a solid metal target to generate LPPs, the resulting conversion efficiency is low since a relatively large amount of heat is needed to melt, vaporize and ionize the solid metal target. Even if a high power pulsed laser is directed to hit liquid metal droplets to generate LPPs, an amount of heat needed to vaporize and ionize the liquid metal droplets is still quite large. In addition, using the liquid metal droplets as targets to be excited requires a complex mechanical system, since the pulsed laser has to be timed and aimed to precisely hit each droplet for stable EUV production.

The present disclosure describes exemplary light generation systems using metal-nonmetal compounds as precursors to be excited by laser light. The metal-nonmetal compound can include a metal component and a nonmetal component surrounding or bonded to the metal component. The nonmetal component can include at least one of an organic component, a halogen component and other types of nonmetal substances. Compared with a pure metal target used for plasma excitation, it takes a small amount of heat to vaporize and ionize the metal-nonmetal compounds. As a result, it is easier to excite the metal-nonmetal compounds to produce plasmas, thus increasing the conversion efficiency and simplifying a corresponding mechanical system. The present disclosure further describes exemplary light generation methods using metal-nonmetal compounds as precursors to be excited by laser light. In some embodiments, as the energy required to excite the metal-nonmetal compounds is low, the energy of laser light which has undergone at least one reflection may be sufficient to excite the metal-nonmetal compounds. Further description is provided below.

FIG. 1A illustrates an exemplary light generation system in accordance with some embodiments of the present disclosure. The light generation system 100 can be employed in a lithography system to emit a light signal LS applicable to a lithography process. By way of example but not limitation, the light generation system 100 can be used as a deep ultraviolet (DUV) or EUV radiation source capable of emitting DUV/EUV light. The light generation system 100 can direct the emitted DUV/EUV light to a photomask, such that the lithography system can utilize the emitted DUV/EUV light for photomask inspection or DUV/EUV exposure. However, those skilled in the art will recognize that the light generation system 100 can be employed in other applications, such as microscopy or lens inspection which employs short wavelength light, without departing from the scope of the present disclosure.

In the present embodiment, the light generation system 100 may include, but is not limited to, a precursor source 110, a vaporization device 120, a chamber 130, a laser device 140, a lens structure 150 and a pump device 160. The precursor source 110 is configured to provide a metal-nonmetal compound MNC in a solid or liquid phase. The metal-nonmetal compound MNC may be a metal organic compound, an organometallic compound, a metal halogen compound, or other types of metal-nonmetal compounds each including a metal component and a nonmetal component surrounding or bonded to the metal component. In some embodiments, the precursor source 110 is configured to melt the metal-nonmetal compound MNC from a solid phase to a liquid phase, and output the metal-nonmetal compound MNC in the liquid phase. In some other embodiments where the metal-nonmetal compound MNC is in a liquid phase at ambient temperature, the precursor source 110 is configured to directly output the metal-nonmetal compound MNC in the liquid phase.

The metal-nonmetal compound MNC may include a metal component and a nonmetal component surrounding or bonded to the metal component. In some embodiments, the nonmetal component may be an organic component, such as functional groups or organic ligands. As a result, the metal-nonmetal compound MNC can be an organometallic compound or a metal organic compound. The organometallic compound contains at least one chemical bond between a carbon atom of an organic molecule and a metal, wherein the metal can be an alkali metal, an alkaline earth metal, a transition metal or a post-transition metal. In contrast to the organometallic compound, the metal organic compound, or a metalorganic compound, contains metals and organic ligands but lacks direct metal-carbon bonds. Rather than directly bonded to a carbon atom, a metal in the metal organic compound is attached to atoms capable of forming dative bonds which are attached to the carbon atom. In some other embodiments, the nonmetal component may be a halogen component. The metal-nonmetal compound MNC can be a metal halogen compound or a metal halide.

The vaporization device 120, connected to the precursor source 110, is configured to vaporize the metal-nonmetal compound MNC to generate a metal-nonmetal precursor gas MPG. In some embodiments, the vaporization device 120 is configured to supply sufficient heat to change the metal-nonmetal compound MNC from a solid or liquid state into a gaseous state. The metal-nonmetal compound MNC in the gaseous state can serve as a precursor gas, i.e. the metal-nonmetal precursor gas MPG. In some embodiments, the vaporization device 120 is configured to reduce a pressure in a solid or liquid metal-nonmetal compound change the solid or liquid metal-nonmetal compound into a gaseous metal-nonmetal compound, i.e. the metal-nonmetal precursor gas MPG. In some other embodiments, the vaporization device 120 is configured to produce the metal-nonmetal precursor gas MPG by not only heating the metal-nonmetal compound MNC but also reducing a pressure surrounding the metal-nonmetal compound MNC.

The chamber 130, connected to the vaporization device 120, is configured to accommodate the metal-nonmetal precursor gas MPG released from the vaporization device 120. The laser device 140 is configured to provide laser light LL, and irradiate the metal-nonmetal precursor gas MPG in the chamber 130 with the laser light LL to emit the light signal LS. The laser device 140 may be a solid state laser, a gas laser, an excimer laser, a liquid laser, a semiconductor laser or other types of lasers. The lens structure 150 is configured to direct or condense the light signal LS to a target object OB. For example, in lithography applications, the lens structure 150 is configured to direct the light signal LS to a photomask used in a lithography process. The photomask may be a transmissive mask, a reflective mask such as a pellicle mask, a phase shift mask or a reticle.

The pump device 160, connected to the chamber 130, is configured to draw the metal-nonmetal precursor gas MPG out of the chamber 130. As a result, particles in the metal-nonmetal precursor gas MPG, which is not hit by the laser light LL or in the lower potential state, would be directed out of the chamber 130 rather than adhering to the lens structure 150, thereby reducing contamination of the lens structure 150.

In operation, the precursor source 110 may provide a liquid stream LQ including the metal-nonmetal compound MNC, and the vaporization device 120 may vaporize the liquid stream LQ to produce the metal-nonmetal precursor gas MPG. Next, the metal-nonmetal precursor gas MPG released into the chamber 130 may be excited to a high-temperature plasma state by the energy of the laser light LL, thus forming a plurality of plasmas (represented by a dotted-line triangle). The light signal LS is released when the metal-nonmetal precursor gas MPG in the high-temperature plasma state transits to a lower potential state. The light signal LS is collected by the lens structure 150 for associated applications. In some embodiments, the light signal LS may include light beams suitable for lithography. The lens structure 150 can direct the light signal LS to an exposure photomask, thereby transferring the design pattern from the photomask to a wafer or a substrate. Additionally or alternatively, the lens structure 150 can direct the light signal LS to a photomask to detect phase defects thereon. By way of example but not limitations, the light signal LS may include DUV or EUV light beams. As a result, the light signal LS can be used for operations in a lithography process such as exposure and inspection.

As the metal-nonmetal precursor gas MPG can include metal-metal bonds, metal-nonmetal bonds and nonmetal-nonmetal bonds, the emitted light signal LS may include light beams of different wavelengths. The lens structure 150 can be implemented to perform filtering operations upon the light signal LS, depending on application scenarios. In some embodiments, when light generation system 100 is employed to detect if the target object OB includes a predetermined material, the lens structure 150 may filter the light signal LS to produce light beams in a predetermined wavelength range. For example, in some application scenarios where light generation system 100 is employed to detect if the target object OB includes tin (Sn) atoms, the lens structure 150 may filter the light signal LS to produce light beams at a wavelength of about 13.5 nm. When such light beams are absorbed by the target object OB, it is determined that the target object OB includes tin atoms.

In some embodiments, when the light signal LS include light beams having wavelengths outside a predetermined wavelength range, the lens structure 150 may perform filtering operation upon the light signal LS, thereby allowing light beams in the predetermined wavelength range to pass through. For example, in some application scenarios where light generation system 100 is used for DUV lithography, when the light signal LS includes light beams having wavelengths outside a DUV wavelength range, e.g. from 150 nm to 300 nm, the lens structure 150 may filter the light signal LS to produce light beams in a DUV wavelength range before directing the light signal LS to target object OB. As another example, in some application scenarios where light generation system 100 is used for EUV lithography, when the light signal LS includes light beams having wavelengths outside an EUV wavelength range, e.g. from 10 nm to 124 nm, the lens structure 150 may filter the light signal LS to produce light beams in an EUV wavelength range before directing the light signal LS to target object OB.

Figure 1B:
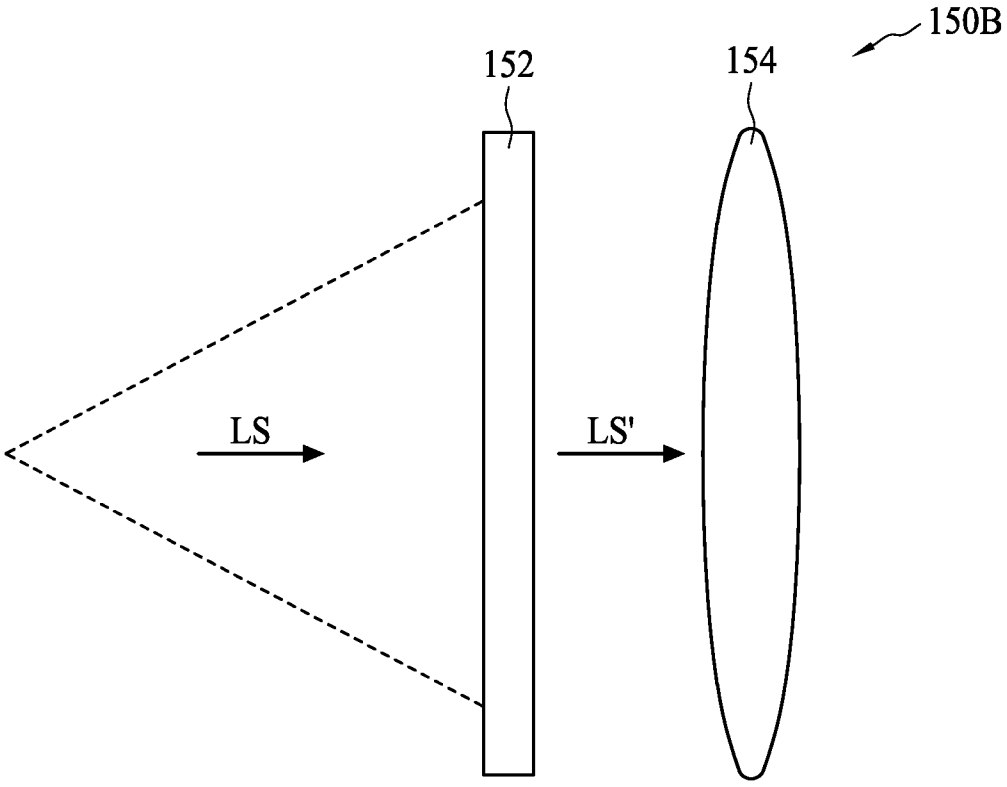
FIG. 1B illustrate an implementation of the lens structure shown in FIG. 1A in accordance with some embodiments of the present disclosure.
Figure 1C:
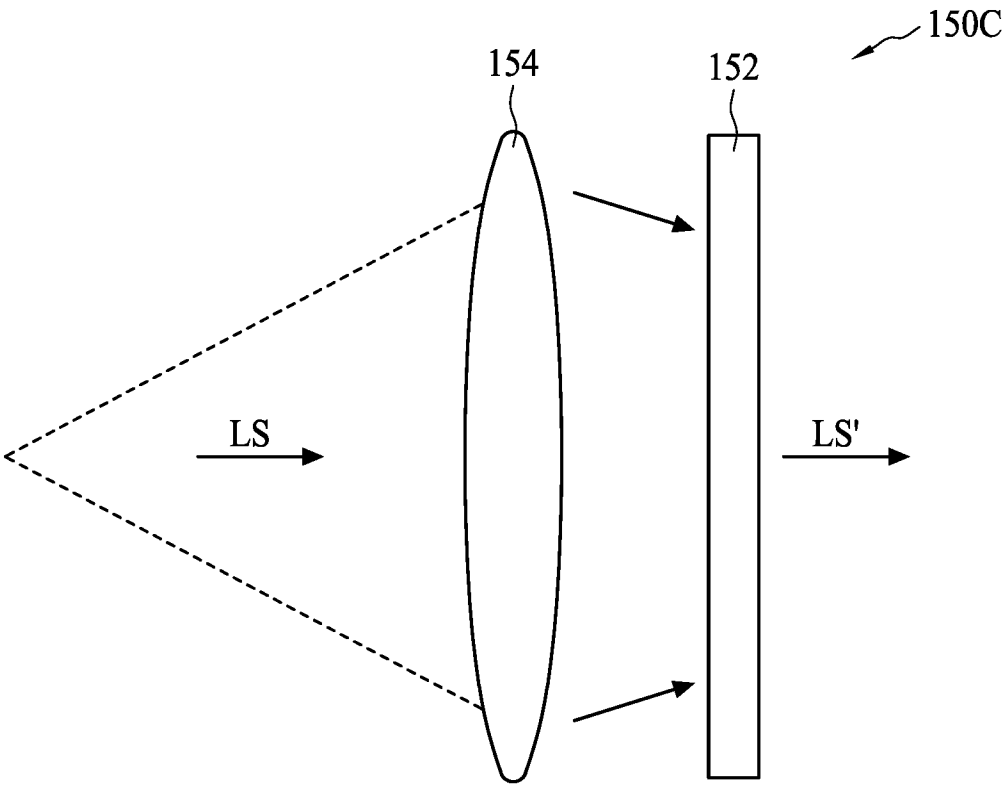
FIG. 1C illustrate an implementation of the lens structure shown in FIG. 1A in accordance with some embodiments of the present disclosure.
Figure 1D:
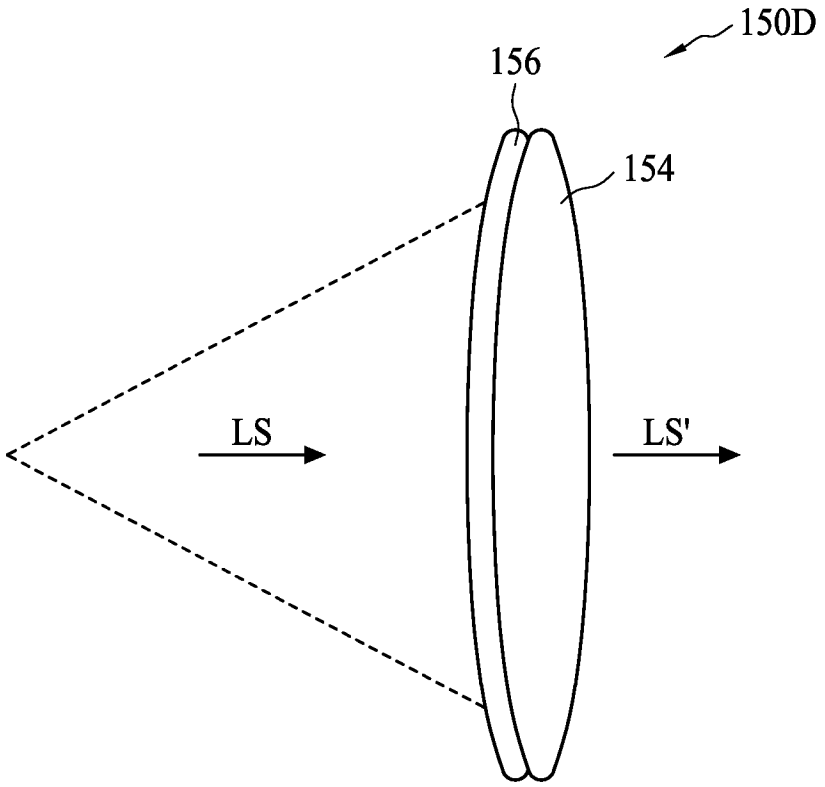
FIG. 1D illustrate an implementation of the lens structure shown in FIG. 1A in accordance with some embodiments of the present disclosure.

FIG. 1B to FIG. 1D illustrate implementations of the lens structure 150 shown in FIG. 1A in accordance with some embodiments of the present disclosure. Referring first to FIG. 1B, the lens structure 150B may include a filter 152 and a focus lens 154. The filter 152 is configured to filter the light signal LS and produce a filtered light signal LS'. The focus lens 154 is configured to direct the filtered light signal LS' toward the target object OB. In the embodiment shown in FIG. 1C, the lens structure 150C is similar to the lens structure 150B shown in FIG. 1B except that the filter 152 is disposed between the focus lens 154 and the target object OB. In the embodiment shown in FIG. 1D, the lens structure 150D is similar to the lens structure 150B shown in FIG. 1B except that a filter layer 156 is coated on the focus lens 154. The filter layer 156 is configured to filter the light signal LS and produce a filtered light signal LS'.

Referring back to FIG. 1A, the lens structure 150 may direct the light signal LS toward the target object OB without filtering the light signal LS in advance in some application scenarios. In some embodiments, when the light generation system 100 is used for determining molecular structures of the target object OB, the lens structure 150 may output the light signal LS to target object OB without filtering the light signal LS in advance. In some embodiments, when a wavelength range of the light signal LS produced from the metal-nonmetal precursor gas MPG falls within a predetermined range, the lens structure 150 may not filter the light signal LS. For example, when a wavelength range of the light signal LS falls within a DUV wavelength range, e.g. from 150 nm to 300 nm, the lens structure 150 may direct the light signal LS to target object OB without filtering the light signal LS in advance. As another example, when a wavelength range of the light signal LS falls within an EUV wavelength range, e.g. from 10 nm to 124 nm, the lens structure 150 may direct the light signal LS to target object OB without filtering the light signal LS in advance.

It is worth noting that the metal-nonmetal compound MNC can have a much lower boiling temperature than the pure metal. As a result, the laser light LL used to irradiate the metal-nonmetal precursor gas MPG can have lower energy than pulsed laser light used to irradiate pure metal droplets. The laser light LL can be provided by a continuous wave (CW) laser or a pulsed laser as long as the laser light has sufficient energy to irradiate the metal-nonmetal precursor gas MPG. In some embodiment, the laser light LL for irradiating the metal-nonmetal precursor gas MPG, e.g. organotitanium compounds, can be provided by a pulsed laser which provides an average power less than at least one tenth of that provided by a pulse layer used to irradiate pure metal droplets, e.g. pure titanium droplets. In some embodiments, the laser light for irradiating the metal-nonmetal precursor gas MPG can be provided by a pulsed laser operate at a pulse repetition rate ranging from 1 Hz to 2 MHz. In some embodiments, the laser light for irradiating the metal-nonmetal precursor gas MPG can be provided by a pulsed laser capable of providing a peak power ranging from 5 kW to 1 MW.

Figure 2:
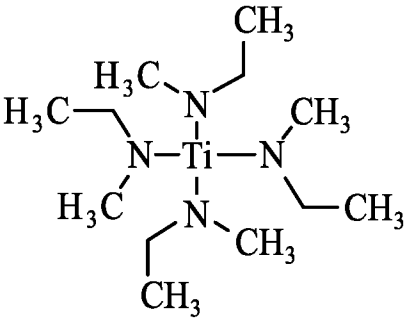
FIG. 2 illustrates embodiments of the metal-nonmetal compound shown in FIG. 1 in accordance with some embodiments.
Figure 2:
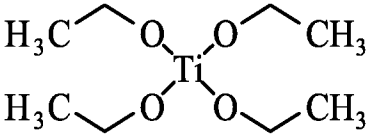
Figure 2:
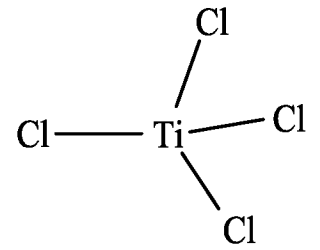

FIG. 2 illustrates embodiments of the metal-nonmetal compound MNC shown in FIG. 1A in accordance with some embodiments of the present disclosure. In the present embodiment, organotitanium compounds, i.e. organic derivatives of titanium (Ti), can represent embodiments of the metal-nonmetal compound MNC shown in FIG. 1. The organotin compounds shown in FIG. 2 include ethylmethylamido titanium, titanium ethoxide and titanium tetrachloride.

An organotin compound can have a much lower boiling temperature than a pure tin metal. For example, the boiling temperature of the pure Ti metal is about 3287° C., while the boiling temperature of the ethylmethylamido titanium is about 80° C. In order to ionize titanium atoms from the pure titanium metal, a pulsed laser is used to provide sufficient energy to overcome the relatively high boiling point of molten titanium droplets as well as the bond energy of the Ti—Ti bond. Heat of vaporization of the pure titanium metal is about 421 kilojoules per mole (kJ/mol), meaning that vaporization of the molten tin droplets consumes a large part of the supplied energy. In contrast, the ethylmethylamido titanium requires low vaporization energy because of the low boiling point. The ethylmethylamido titanium can be vaporized without laser light. Hence, a laser capable of providing sufficient energy to overcome the bond energy of the Ti—N bond, about 464 kJ/mol, can be utilized to ionize tin atoms from the ethylmethylamido titanium in a gaseous phase. This means that using a metal-nonmetal compound as a plasma precursor can significantly reduce laser power provided for the metal-nonmetal compound. For example, average power of a pulsed laser for generating plasmas from pure Ti droplets may be about 10 W, while average power of a pulsed laser for generating plasmas from ethylmethylamido titanium may be about 10 to 100 mW.

Additionally, as the laser power is reduced, the metal-nonmetal compound can be successfully excited by laser light having low or moderate power, such as laser light undergoing one or more reflections. In some embodiments, a reflective optical structure such as a lens structure can be used to fully utilize laser light provided by a laser device. Referring back to FIG. 1A, the light generation system 100 can further include a reflective optical structure 170, which is configured to reflect the laser light LL. Even if the laser light LL fails to hit the metal-nonmetal precursor gas MPG in the beginning, the metal-nonmetal precursor gas MPG can be irradiated by reflected laser light RL, which is produced by at least one reflection of the laser light LL on the reflective optical structure 170. In the present embodiment, the reflective optical structure 170 includes, but is not limited to, a plurality of reflective lenses 172 and 174. A light beam LB1 included in the laser light LL, which fails to hit the metal-nonmetal precursor gas MPG in the beginning, can be reflected by the reflective lenses 172 and 174 in sequence. The resulting light beam LB2 can be directed toward the target object OB by the reflective lens 174.

Although the light beam LB2 may have less energy than the light beam LB1 because of multiple reflections, the metal-nonmetal precursor gas MPG can be irradiated as long as the light beam LB2 can provide sufficient energy to overcome metal-nonmetal bond energy of the metal-nonmetal precursor gas MPG. Compared to a mechanical system using liquid metal droplets as targets to be excited, the light generation system 100 can have a simplified structure because of an increased tolerance of aiming accuracy of the metal-nonmetal precursor gas MPG.

Figure 3:
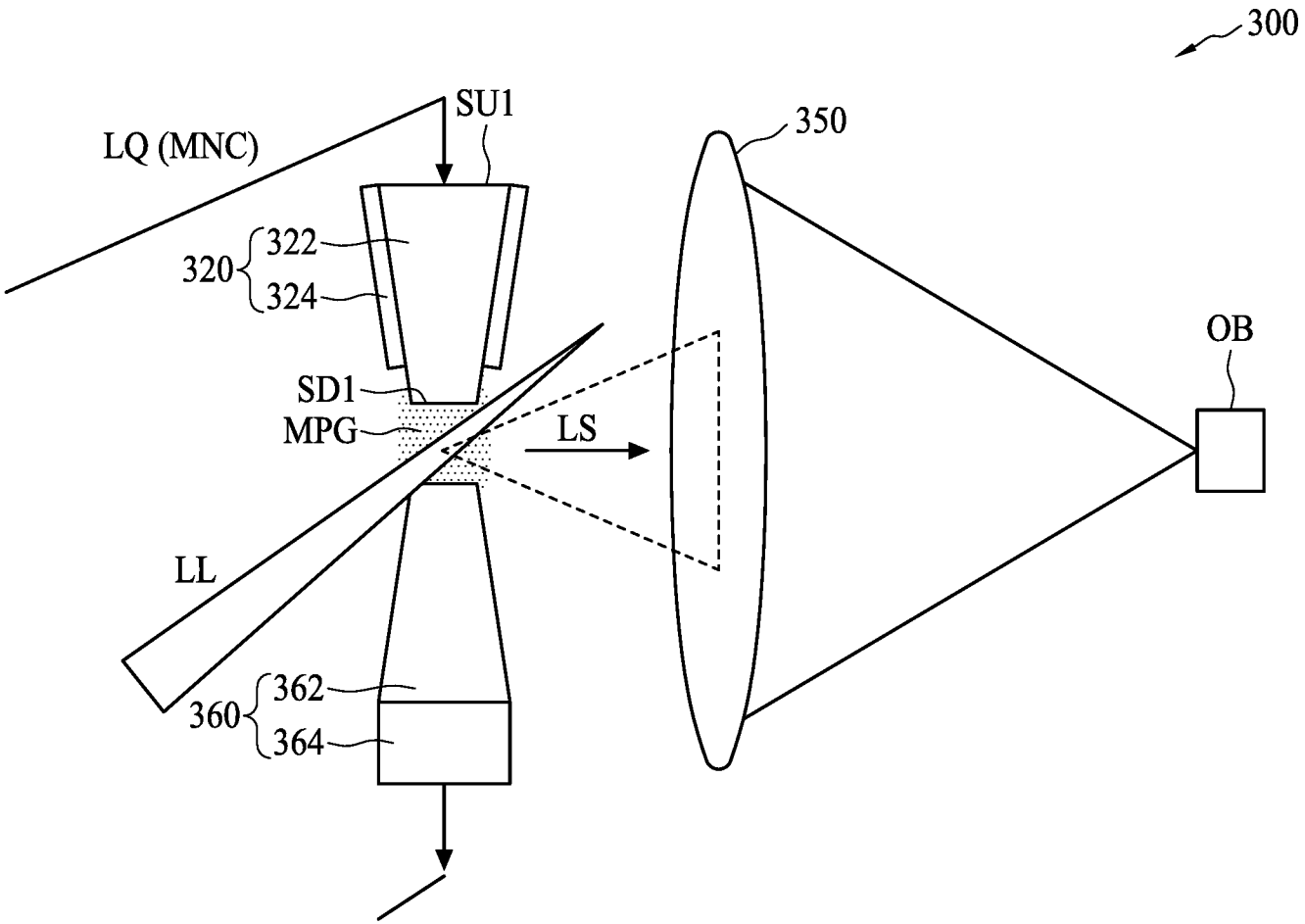
FIG. 3 illustrates an exemplary light generation system in accordance with some embodiments.

FIG. 3 illustrates an exemplary light generation system 300 in accordance with some embodiments of the present disclosure. The light generation system 300 can represent an embodiment of the light generation system 100 shown in FIG. 1A. In the present embodiment, the light generation system 300 includes a heating nozzle 320, a focus lens 350 and a pump device 360. The heating nozzle 320 can represent an embodiment of at least a part of the vaporization device 120 shown in FIG. 1A. The focus lens 350 can represent an embodiment of at least a part of the lens structure 150 shown in FIG. 1A. The pump device 360 can represent an embodiment of at least a part of the pump device 160 shown in FIG. 1A.

The heating nozzle 320 is configured to receive the liquid stream LQ including the metal-nonmetal compound MNC. The liquid stream LQ can include fluid metal organic compounds, fluid organometallic compounds, fluid metal halogen compounds, or combinations thereof. Also, the heating nozzle 320 is configured to heat the metal-nonmetal compound MNC to convert the metal-nonmetal compound MNC from a liquid phase into a gaseous phase. The metal-nonmetal compound MNC in the gaseous phase serves as the metal-nonmetal precursor gas MPG.

In the present embodiment, the liquid stream LQ flows through the heating nozzle 320 from an upstream side SU1 toward a downstream side SD1 of the heating nozzle 320. The downstream side SD1 can have a flow area smaller than a flow area of the upstream side SU1. As a result, a fluid metal-nonmetal compound flowing into the heating nozzle 320 is compressed first, and undergoes a large pressure drop when released from the downstream side SD1. This helps vaporization of the fluid metal-nonmetal compound.

The heating nozzle 320 can include, but is not limited to, a nozzle component and a heater 324. The nozzle body 322 is configured to accommodate the liquid stream LQ, i.e. the metal-nonmetal compound MNC in a liquid phase. The nozzle body 322 can include thermally conductive materials, including metal materials, such as steel, Beryllium copper, tungsten and molybdenum, ceramic materials or any other suitable thermally conductive materials.

The heater 324, surrounding the nozzle body 322, is configured to heat the liquid stream LQ in the nozzle component 322 to convert the metal-nonmetal compound MNC from the liquid phase into a gaseous phase. It is worth noting that the nozzle component 322 and the heater 324 shown in FIG. 3 are for illustrative purposes only. Those skilled in the art should appreciate that various vaporization devices can be used to produce the metal-nonmetal precursor gas MPG without departing from the scope of the present disclosure.

The focus lens 350 is configured to collect the light signal LL, and direct the light signal LL to a target object OB such as a photomask used in a lithography process. The pump device 360, disposed in correspondence with the heating nozzle 320, may include a pump nozzle 362 and a pump 364. The pump nozzle 362, controlled by the pump 364, is configured to draw the metal-nonmetal precursor gas MPG out of a chamber (not shown in FIG. 3) to reducing contamination of the focus lens 350. In some embodiments, the pump nozzle 362 can be disposed within a predetermined distance, e.g. as 300 μm, apart from heating nozzle 320 to apply sufficient suction force to the metal-nonmetal precursor gas MPG. In some embodiments, the smaller an area of an upstream side SU2 of the pump nozzle 362 is, the larger the suction force applied to the metal-nonmetal precursor gas MPG can be.

Figure 4:
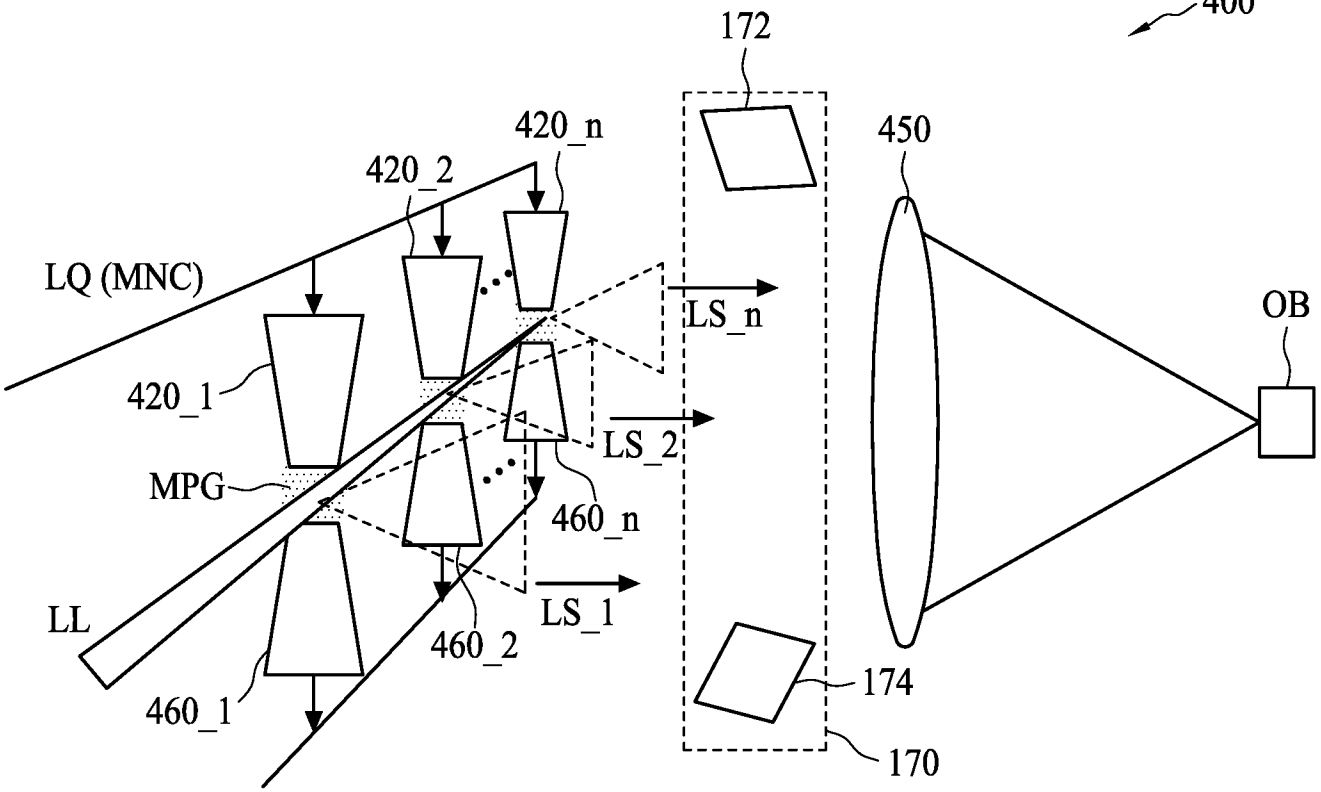
FIG. 4 illustrates another exemplary light generation system in accordance with some embodiments.

In some embodiments, it is possible to use a plurality of heating nozzles to vaporize a metal-nonmetal compound in a parallel manner to increase intensity of collected light. FIG. 4 illustrates another exemplary light generation system in accordance with some embodiments of the present disclosure. The light generation system 400 can represent an embodiment of the light generation system 100 shown in FIG. 1A. In the present embodiment, the light generation system 400 includes a plurality of heating nozzles **420_1-420_*n*, a focus lens 450 and a plurality of pump nozzles 460_1-460_*n*, n being a positive integer greater than one. The heating nozzles 420_1-420_*n* can represent an embodiment of at least a part of the vaporization device 120 shown in FIG. 1A. The focus lens 450 can represent an embodiment of at least a part of the lens structure 150 shown in FIG. 1A. The pump nozzles 460_1-460_*n* can represent an embodiment of at least a part of the pump device 160 shown in FIG. 1**A.

In the present embodiment, each of the heating nozzles **420_1-420_*n* can be similar to the heating nozzle 320 described and illustrated with reference to FIG. 3. Each heating nozzle is configured to receive a portion of the liquid stream LQ including the metal-nonmetal compound MNC, the liquid stream LQ being provided by a precursor source such as the precursor source 130 shown in FIG. 1A. Also, the heating nozzle is configured to heat a portion of the liquid stream LQ to generate a portion of the metal-nonmetal precursor gas MPG. When released from the heating nozzle, the portion of the metal-nonmetal precursor gas MPG can be irradiated with the laser light LL to emit a light signal, i.e. one of light signals LS_1**-LS_n.

The focus lens 450 is configured to collect the light signals LS_1-LS_n, and direct the light signals LS_1-LS_n toward the target object OB, such as a photomask used in a lithography process, a microscope lens, or a lens to be inspected.

The pump nozzles **460_1-460_*n* are disposed in correspondence with the heating nozzles 420_1-420_*n* respectively. Each of the pump nozzles 460_1-460_*n* can be similar to the pump nozzle 362 described and illustrated with reference to FIG. 3. Each pump nozzle is configured to draw a portion of the metal-nonmetal precursor gas MPG out of a chamber (not shown in FIG. 3) to reducing contamination of the focus lens 450**.

In the present embodiment, the light generation system 400 may further include the reflective optical structure 170 shown in FIG. 1A. As a result, in addition to increasing intensity of the collected light and reducing contamination of the focus lens 450, the light generation system 400 can increase tolerance of aiming accuracy of the metal-nonmetal precursor gas MPG.

It is worth noting that the heating nozzles shown in FIG. 3 and FIG. 4 are for illustrative purposes only. Those skilled in the art should appreciate that various vaporization devices can be used to produce a metal-nonmetal precursor gas without departing from the scope of the present disclosure.

Figure 5:
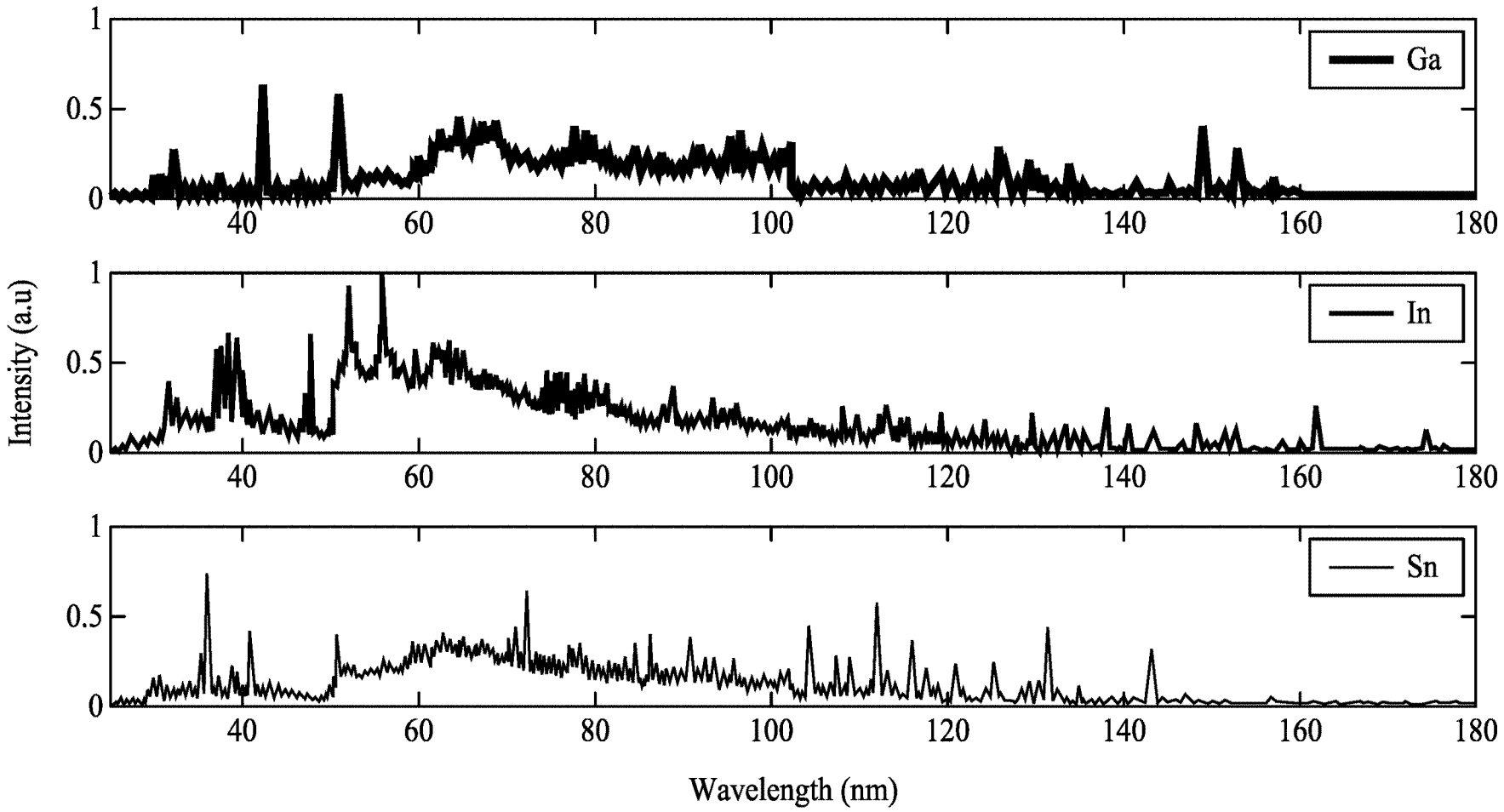
FIG. 5 illustrates spectral irradiance distributions associated with metal ions in different oxidation states in accordance with some embodiments.

FIG. 5 illustrates plasma emission spectra for different fuels, i.e. different types of droplets, in accordance with some embodiments. These spectra were obtained in He ambient gas at 0.1 mbar for a peak irradiance of $1.2\times10^{11}$ W/cm$^2$. Several emission lines for each fuel can be observed. As shown in FIG. 5, different types of fuels correspond to different spectrums. For example, gallium (Ga) presents one evident emission line at 42.3 nm due to the GaIV ion transitions levels $^1P_0 3d^9 4_p$-$^1S3d^{10}$. Indium (In) presents several emission lines around 40 nm due to InV ion transitions. Tin (Sn) has two sharp emission lines at 35.51 nm and 36.10 nm due to SnV ion transitions. Hence, when a light beam of a predetermined wavelength is desired, a metal-nonmetal compound having a predetermined core metal, i.e. a predetermined metal component, can be chosen according to the predetermined wavelength. Also, as a fuel may have multiple emission lines due to different ion transitions, a core metal of a metal-nonmetal compound can exhibit multiple emission lines due to different oxidation states thereof. As a result, irradiating a metal-nonmetal precursor gas with laser light can emit a light signal which includes light beams of different wavelengths. In some embodiments, a light beam of a predetermined wavelength can be obtained using filtering techniques. By way of example but not limitation, for DUV/EUV applications, an optical filter or a lens structure, such as the lens structure 150 shown in FIG. 1A, can be used to allow DUV/EUV light to pass through.

FIG. 6 shows energy required for vaporizing and exciting a metal-nonmetal compound in accordance with some embodiments. In the present embodiment, an organotitanium compound (MO—Ti) having a boiling point of about 80° C., or titanocene, serves as the metal-nonmetal compound for illustrative purposes. FIG. 6 also shows energy required for vaporization and excitation of pure titanium (Ti) metal for comparison. Each of the pure Ti metal and the organotitanium compound is placed in a space of three cubic micrometers. The molar amount of the pure Ti metal is $0.2\times10^{12}$ moles, and the molar amount of the organotitanium compound is $0.9\times10^{9}$ moles. The organotitanium compound may include Ti—O bonds, Ti—C bonds and Ti—Cl bonds.

As shown in FIG. 6, the total energy required to melt, gasify and ionize the pure Ti metal is about 16 orders of magnitudes in terms of joules. In contrast, the total energy required to vaporize and ionize the organotitanium compound, including breaking the Ti—O/Ti—C/Ti—Cl bond, is about 14 orders of magnitudes in terms of joules. Hence, using the organotitanium compound, or a metal-nonmetal compound, as a precursor can greatly reduce the total energy required for vaporization and plasma excitation.

Figure 7:
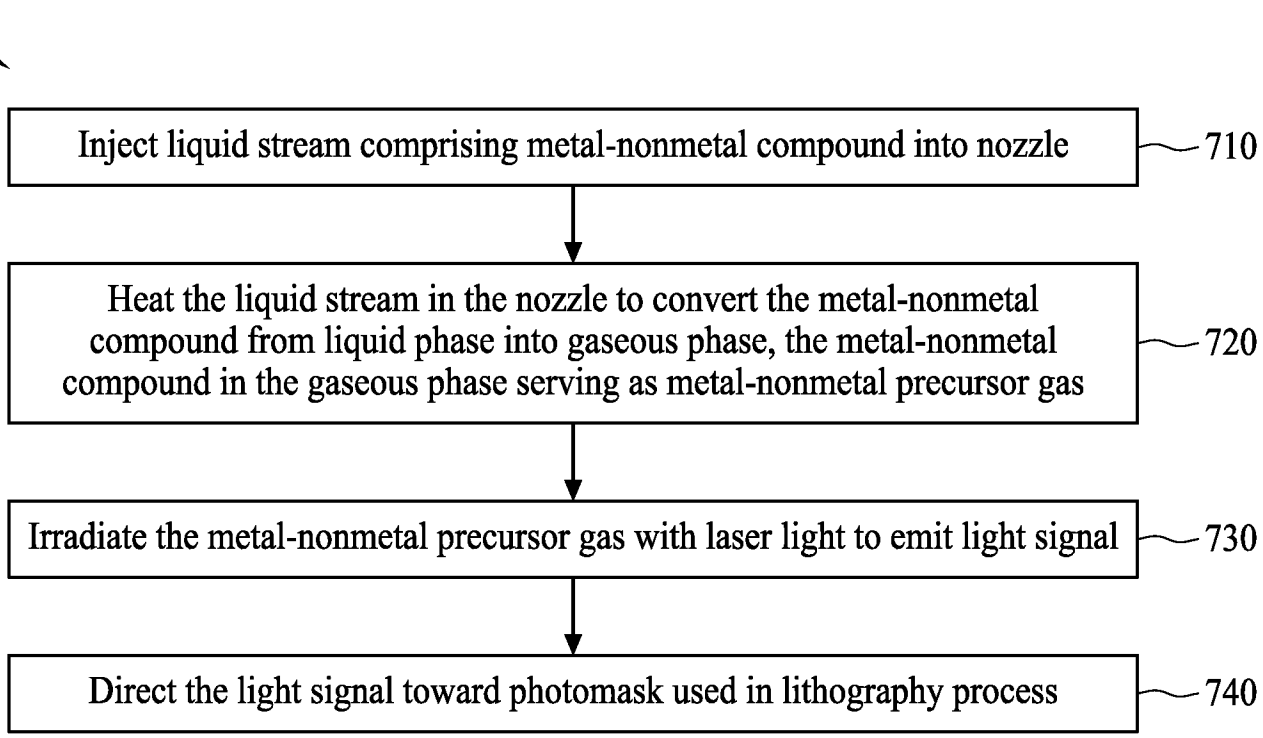
FIG. 7 illustrates a flow chart of an exemplary light generation method in accordance with some embodiments

FIG. 7 illustrates a flow chart of an exemplary light generation method in accordance with some embodiments of the present disclosure. The light generation method 700 shown in FIG. 7 may be employed in at least one of the light generation system 100 shown in FIG. 1, the light generation system 300 shown in FIG. 3, and the light generation system 400 shown in FIG. 4 to emit light beams with the use of a low power laser. For illustrative purposes, the method shown in FIG. 7 is described below with reference to the light generation system 300 shown in FIG. 3. In some embodiments, other operations in the method 700 can be performed. In some embodiments, operations of the method 700 can be performed in a different order and/or vary.

At operation 710, a liquid stream including a metal-nonmetal compound is injected into a nozzle. For example, the liquid stream LQ including the metal-nonmetal compound MNC is injected into the heating nozzle 320. The metal-nonmetal compound MNC can be a metal organic compound, an organometallic compound, a metal halogen compound or other types of metal-nonmetal compounds. In some embodiments, the liquid stream LQ can be provided by a precursor source such as the precursor source 110 shown in FIG. 1.

At operation 720, the liquid stream in the nozzle is heated to convert the metal-nonmetal compound from a liquid phase into a gaseous phase. The metal-nonmetal compound in the gaseous phase can serve as a metal-nonmetal precursor gas. For example, the heating nozzle 320 can supply sufficient heat to convert the metal-nonmetal compound MNC from a liquid phase into a gaseous phase, thereby producing the metal-nonmetal precursor gas MPG.

At operation 730, the metal-nonmetal precursor gas is irradiated with laser light to emit a light signal. The laser light can be provided by a solid state laser, a gas laser, an excimer laser, a liquid laser, a semiconductor laser or other types of lasers. For example, the laser device 140 can provide the laser light LL to excite the metal-nonmetal precursor gas MPG to a high-temperature plasma state, thereby forming a plurality of plasmas. When the metal-nonmetal precursor gas MPG in the high-temperature plasma state transits to a lower potential state, the light signal LS is emitted.

In some embodiments, the laser light which has undergone one or more reflections may still have sufficient energy to excite the metal-nonmetal precursor gas to form plasmas. For example, instead of hitting the metal-nonmetal precursor gas in the beginning, the provided laser light may be reflected by a reflective optical structure at least once to produce reflected laser light. The metal-nonmetal precursor gas can be irradiated with the reflected laser light to form plasmas.

At operation 740, the light signal is directed toward a target object. The target object can be, but is not limited to, a photomask used in a lithography process. For example, the lens structure 150 can direct the emitted light signal LS to a photomask used in a lithography process, thereby detecting defects on the photomask or transferring the design pattern from the photomask to a wafer or a substrate. In some embodiments, the light signal LS can be directed toward other types of target objects based on application scenarios. For example, the light signal LS can be directed to a microscope lens for microscopy application, or directed to an optical lens for lens inspection.

With use of metal-nonmetal compounds as precursors for plasma excitation, laser light having low or moderate energy, rather than high power pulsed laser light, is sufficient to irradiate the metal-nonmetal compounds to emit light beams. High power light beams, such as DUV or EUV light beams, can be produced using low power lasers. As the metal-nonmetal compounds have low boiling points, the total energy required for light irradiation is also reduced. In addition, it is easier to excite the metal-nonmetal compounds to produce plasmas, thus increasing the conversion efficiency and simplifying a corresponding mechanical system. Further, metal-nonmetal precursor gases, which are not hit by laser light or in the lower potential states, can be easily drawn out of a chamber. This can reduce contamination of a lens structure which is used for collecting emitted light beams.

Some embodiments described herein may include a light generation system that includes a vaporization device, a laser device and a lens structure. The vaporization device is configured to vaporize a metal-nonmetal compound to generate a metal-nonmetal precursor gas. The laser device is configured to provide laser light, and irradiate the metal-nonmetal precursor gas released from the vaporization device with the laser light to emit a light signal. The lens structure is configured to direct the light signal toward a photomask used in a lithography process.

Some embodiments described herein may include a light generation method that includes injecting a liquid stream comprising a metal-nonmetal compound into a nozzle; heating the liquid stream in the nozzle to convert the metal-nonmetal compound from a liquid phase into a gaseous phase, the metal-nonmetal compound in the gaseous phase serving as a metal-nonmetal precursor gas; irradiating the metal-nonmetal precursor gas with laser light to emit a light signal; and directing the light signal toward a photomask used in a lithography process.

Some embodiments described herein may include a light generation method that includes injecting a liquid stream comprising a metal-nonmetal compound into a nozzle; heating the liquid stream in the nozzle to convert the metal-nonmetal compound from a liquid phase into a gaseous phase, the metal-nonmetal compound in the gaseous phase serving as a metal-nonmetal precursor gas; irradiating the metal-nonmetal precursor gas with laser light to emit a light signal; and filtering the light signal to produce a light beam having a predetermined wavelength.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A light generation system, comprising:

a vaporization device, configured to vaporize a metal-nonmetal compound to generate a metal-nonmetal precursor gas;

a laser device, configured to provide laser light, and irradiate the metal-nonmetal precursor gas released from the vaporization device with the laser light to emit a light signal; and a lens structure, configured to direct the light signal toward a photomask used in a lithography process.

2. The light generation system of claim 1, wherein the metal-nonmetal compound is a metal organic compound or an organometallic compound.

3. The light generation system of claim 1, wherein the metal-nonmetal compound is a metal halogen compound.

4. The light generation system of claim 1, wherein the vaporization device is configured to receive a liquid stream comprising the metal-nonmetal compound; the vaporization device comprises:

one or more heating nozzles, each heating nozzle configured to receive at least one portion of the liquid stream, and heat the at least one portion of the liquid stream to generate at least one portion of the metal-nonmetal precursor gas.

5. The light generation system of claim 4, wherein each heating nozzle comprises an upstream side and a downstream side; the at least one portion of the liquid stream flows through the heating nozzle from the upstream side toward the downstream side; and the downstream side having a flow area smaller than a flow area of the upstream side.

6. The light generation system of claim 4, further comprising:

one or more pump nozzles, each pump nozzle configured to draw at least one portion of the metal-nonmetal precursor gas out of the chamber, wherein a distance between an downstream side of one of the heating nozzles and an upstream side of one of the pump nozzles is less than or equal to 300 μm.

7. The light generation system of claim 1, further comprising:

a reflective optical structure, configured to reflect the laser light, the metal-nonmetal precursor gas being irradiated by reflected laser light, the reflected laser light being produced by at least one reflection of the laser light on the reflective optical structure.

8. The light generation system of claim 1, wherein the lens structure is configured to filter the light signal to produce a light beam having a predetermined wavelength, and direct the light beam toward the photomask.

9. The light generation system of claim 1, further comprising:

a chamber, configured to accommodate the metal-nonmetal precursor gas; and a pump device, configured to draw the metal-nonmetal precursor gas out of the chamber.

10. The light generation system of claim 9, wherein the pump device comprises:

one or more pump nozzles, each pump nozzle configured to draw at least one portion of the metal-nonmetal precursor gas out of the chamber.

11. A light generation method, comprising:

injecting a liquid stream comprising a metal-nonmetal compound into a nozzle;

heating the liquid stream in the nozzle to convert the metal-nonmetal compound from a liquid phase into a gaseous phase, the metal-nonmetal compound in the gaseous phase serving as a metal-nonmetal precursor gas;

irradiating the metal-nonmetal precursor gas with laser light to emit a light signal; and directing the light signal toward a photomask used in a lithography process.

12. The light generation method of claim 11, wherein the metal-nonmetal compound is a metal organic compound, an organometallic compound or a metal halogen compound.

13. The light generation method of claim 11, wherein irradiating the metal-nonmetal precursor gas with laser light comprises:

reflecting the laser light at least once to produce reflected laser light; and irradiating the metal-nonmetal precursor gas with the reflected laser light.

14. The light generation method of claim 11, further comprising:

accommodating the metal-nonmetal precursor gas in a chamber; and drawing at least one portion of the metal-nonmetal precursor gas out of the chamber.

15. The light generation method of claim 11, wherein directing the light signal toward the photomask used in the lithography process comprises:

filtering the light signal to produce a light beam having a predetermined wavelength; and direct the light beam toward the photomask.

16. A light generation method, comprising:

injecting a liquid stream comprising a metal-nonmetal compound into a nozzle;

heating the liquid stream in the nozzle to convert the metal-nonmetal compound from a liquid phase into a gaseous phase, the metal-nonmetal compound in the gaseous phase serving as a metal-nonmetal precursor gas;

irradiating the metal-nonmetal precursor gas with laser light to emit a light signal; and filtering the light signal to produce a light beam having a predetermined wavelength.

17. The light generation method of claim 16, wherein the metal-nonmetal compound is a metal organic compound, an organometallic compound or a metal halogen compound.

18. The light generation method of claim 16, wherein the wavelength frequency is within a deep ultraviolet wavelength range or an extreme ultraviolet wavelength range.

19. The light generation method of claim 16, further comprising:

direct the light signal toward a photomask used in a lithography process.

20. The light generation method of claim 16, wherein irradiating the metal-nonmetal precursor gas with laser light comprises:

reflecting the laser light at least once to produce reflected laser light; and irradiating the metal-nonmetal precursor gas with the reflected laser light.

* * * * *